United States Patent [19]

Negishi

[11] Patent Number: 4,928,501

[45] Date of Patent: May 29, 1990

[54] COLD PRESERVING CONTAINER

[75] Inventor: Kozaburo Negishi, Isesaki, Japan

[73] Assignee: Sanden Corporation, Japan

[21] Appl. No.: 393,030

[22] Filed: Aug. 11, 1989

Related U.S. Application Data

[63] Continuation of Ser. No. 324,030, Mar. 16, 1989, abandoned.

[30] Foreign Application Priority Data

Mar. 17, 1988 [JP] Japan ..... 63-34441[U]

[51] Int. Cl.[5] ..... F25D 17/04

[52] U.S. Cl. ..... 62/406; 62/430; 62/438; 62/439; 62/440

[58] Field of Search ..... 62/430, 438, 439, 406, 62/440, 434, 457.1

[56] References Cited

U.S. PATENT DOCUMENTS

| | | | |
|---|---|---|---|
| 1,673,860 | 6/1928 | Wood et al. | 62/438 |
| 1,845,888 | 2/1932 | Rutishauser | 62/439 X |
| 2,191,198 | 2/1940 | Gould | 62/438 |
| 2,289,728 | 7/1942 | Rees | 62/438 X |
| 2,323,354 | 7/1943 | Rees | 62/438 X |
| 2,332,027 | 10/1943 | Swanson | 62/406 X |
| 2,428,312 | 9/1947 | Herbener | 62/438 X |
| 2,534,272 | 12/1950 | Kleist | 62/335 X |
| 2,702,457 | 2/1955 | Kogel et al. | 62/439 X |
| 2,957,317 | 10/1960 | Parker | 62/439 X |
| 4,633,677 | 1/1987 | Maehara | 62/256 |
| 4,637,220 | 1/1987 | Sakano | 62/200 |
| 4,637,222 | 1/1987 | Fujjwara et al. | 62/244 |
| 4,748,823 | 6/1988 | Asano et al. | 62/239 |
| 4,827,731 | 5/1989 | Ikeda | 62/161 |
| 4,831,837 | 5/1989 | Negishi et al. | 62/239 |

FOREIGN PATENT DOCUMENTS

| | | |
|---|---|---|
| 61-138068 | 6/1986 | Japan . |
| 61-147078 | 7/1986 | Japan . |
| 61-153362 | 7/1986 | Japan . |
| 61-127376 | 8/1986 | Japan . |
| 61-231377 | 10/1986 | Japan . |
| 62-29877 | 2/1987 | Japan . |
| 62-38568 | 3/1987 | Japan . |
| 62-84279 | 4/1987 | Japan . |

*Primary Examiner*—Lloyd L. King

*Attorney, Agent, or Firm*—Banner, Birch, McKie & Beckett

[57] ABSTRACT

A cold preserving container including a goods container space, a dish-like member above the space, a cold accumulator enclosing a cold regenerative material and disposed in the dish-like member, a heat insulating wall forming an air path between the wall and the dish-like member, and a blower circulating air between the air path and the goods container space. The cold accumulator cools the air in the disk-like member, the cooled air can fall down into the goods container space and circulate between the space and the air path by driving the blower. Since the cooling of the air in the space is controlled by the drive control of the blower, the temperature of the inside air can be easily controlled and maintained at the desired temperature despite variations in outside air temperatures. Moreover, since the cold accumulator is disposed in the dish-like member, the stable structure of the cooling portion of the container can be easily achieved, thereby providing a container suitable for a long distance transportation.

31 Claims, 5 Drawing Sheets

COLD PRESERVING CONTAINER

This application is a continuation of application Ser. No. 324,030, filed Mar. 16, 1989, now abandoned.

BACKGROUND OF THE INVENTION

1. Field of the Invention

The present invention relates to a cold preserving container having means for cold accumulation which can preserve the cold in a goods container space of the container.

2. Description of the Prior Art

The conventional cold preserving container has a heat insulating chamber which is formed by a heat insulating box and a door constructed of heat insulating walls. A cold accumulation component enclosing a cold regenerative material is placed in an upper portion of the heat insulating chamber. Goods contained in the goods container space are cooled by the cold air falling down from the cold accumulation component. The cold accumulation component can be removed from the heat insulating chamber and cooled as needed.

Such a conventional container has the advantages that its structure is simple and that the increase of the temperature inside of it can be lowered even where there is no power source. Therefore, the container is convenient where it is to be transported, as by a vehicle. Also, casters are often attached to the container, thereby making it easy to move or transport the container.

However, the conventional cold preserving container, such as the one described above, has the problem that the temperature in the goods container space cannot be controlled.

A cold regenerative material used for a cold accumulation component usually generates cold air having a constant temperature. Therefore, the temperature of the inside atmosphere cooled by the cold air by the cold accumulation component changes with varying outside air temperatures, and it is difficult to maintain the temperature inside of the container at a constant value. Accordingly, for example where the atmosphere or air in the goods container space of the container can be cooled to an adequate temperature in a warm area, the inside air is cooled too much when the container is transported to a cold area, and the contained goods often freeze. In the converse case the goods contained in the container warm and the container often cannot function as a cold preserving container. Particularly, when the contained goods are fresh provisions, the freezing or the warming thereof cannot be allowed.

Moreover, since the cold accumulation component is merely placed in the upper portion of the heat insulating chamber, as on a rack, in the conventional container, it is structurally unstable. This is especially so when the container is transported for long distances, as by a vehicle.

SUMMARY OF THE INVENTION

Accordingly, an object of the present invention is to provide a cold preserving container which can control the temperature in a goods container space relative to the outside air temperature, thereby maintaining the inside temperature at the desired temperature.

Another object of the present invention is to provide a stable cold preserving container suitable for a long distance transportation as by a vehicle.

Directed to achieving these objects, a cold preserving container is herein provided. The container has a goods container space surrounded by first heat insulating walls. The container includes a dish-like member above the goods container space and opening upwards and means for cold accumulation disposed in the dish-like member. The cold accumulation means encloses a cold regenerative material. The container includes a second heat insulating wall covering and spaced above the dish-like member. The second insulating wall and the dish-like member form an air path, and the air path communicates with the goods container space at air path end portions. A blower disposed in the air path then circulates air between the air path and the goods container space.

In the cold preserving container, the cold accumulation means is cooled by a cooling system built in the container or by an external cooling system, and is adapted to hold the cold temperature. Since the cold accumulation means is disposed in the dish-like member, the member is filled with the cold air generated by the means. When the blower is driven, the air in the air path and in the goods container space is circulated between the air path and the goods container space, and the cold air cooled by the cold accumulation means in the dish-like member falls down to the goods container space and is circulated between the space and the air path. When the blower is stopped, the cold air in the dish-like member generally does not flow out from the inside of the member. Thus, the temperature in the goods container space can be controlled by controlling the drive of the blower. As a result, the temperature inside of the container can be maintained at the desired temperature despite variations in the outside air temperature.

Moreover, since the cold accumulation means is disposed in the dish-like member, it can be set or fixed in the member so as to be structurally stable. Therefore, even during long distance transportation, the setting of the cold accumulation means can be stably maintained.

BRIEF DESCRIPTION OF THE DRAWINGS

Preferred exemplary embodiments of the invention will now be described with reference to the accompanying drawings which are given by way of example only, and thus are not intended to limit the present invention.

DETAILED DESCRIPTION OF PREFERRED EMBODIMENTS 0F THE INVENTION

Figure 1:
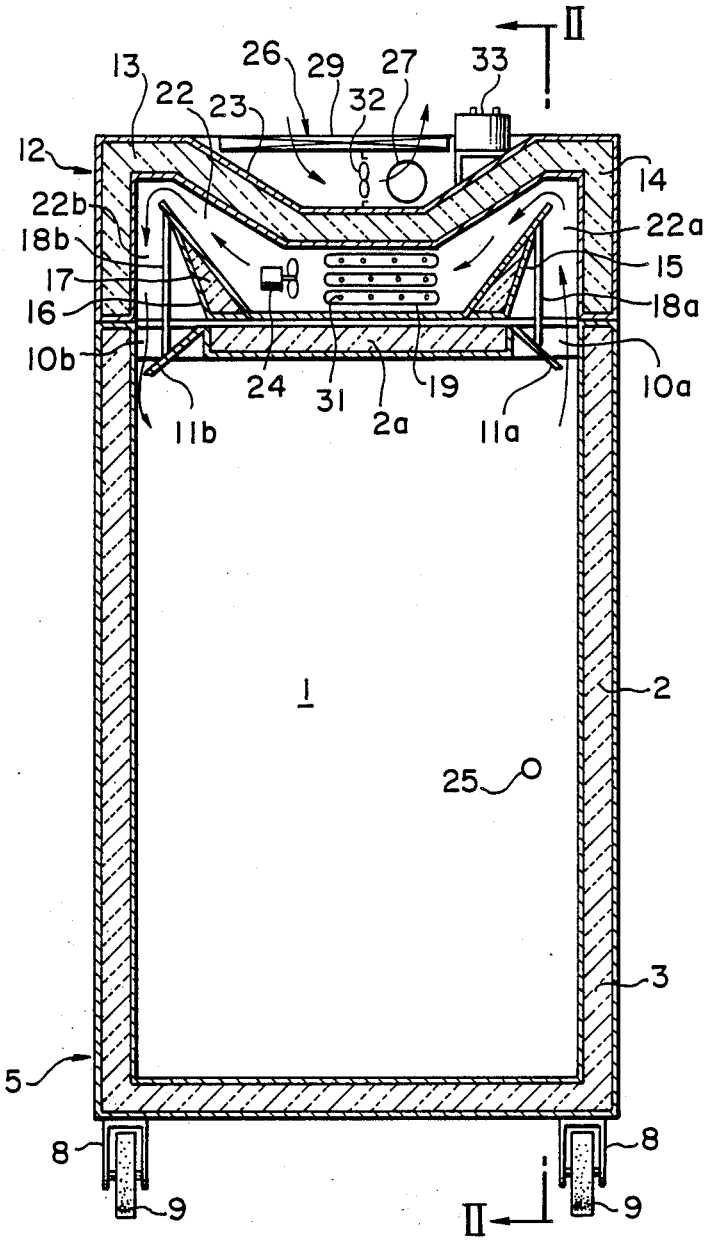
FIG. 1 is a vertical sectional view of a cold preserving container according to an embodiment of the present invention.
Figure 2:
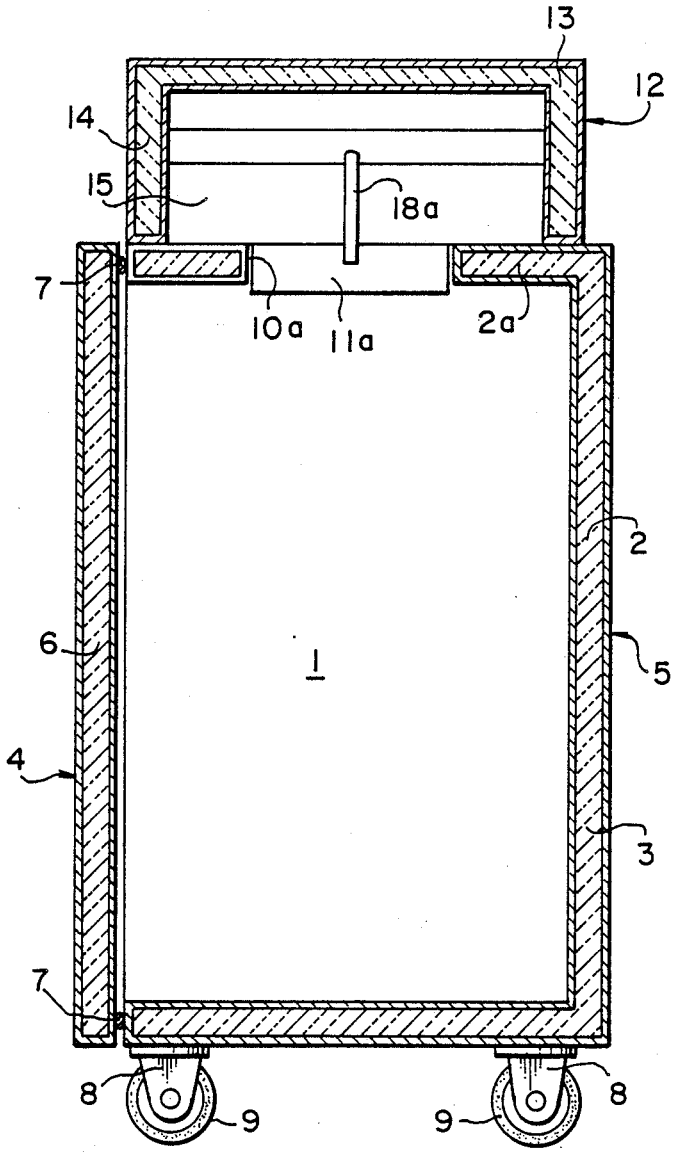
FIG. 2 is a vertical sectional view of the cold preserving container shown in FIG. 1 taken along line II—II of FIG. 1.

Referring to the drawings, FIGS. 1–5 illustrate a cold preserving container according to an embodiment of the present invention. The cold preserving container has a goods container space 1 surrounded by first heat insulating walls 2. Heat insulating walls 2 include a heat insulating material 3 therein. Heat insulating walls 2 are constructed as a box, and a door 4 is attached to the front surface of the box. Heat insulating walls 2 and door 4 constitute a heat insulating box 5 and goods container space 1 thereby defines a heat insulating chamber. Door 4 also includes a heat insulating material 6. A packing 7 attached on the back side surface of door 4 provides a seal between the door and heat insulating walls 2 when the door is closed. Casters 8 with wheels 9 are attached on the bottom surface of heat insulating box 5.

Openings 10*a* and 10*b* are provided on an upper heat insulating wall 2*a*. Opening 10*a* functions as an air flow path up from goods container space 1 and opening 10*b* functions as an air flow path down to the goods container space. Dampers 11*a* and 11*b* provided in openings 10*a* and 10*b*, respectively, are movable so as to open and close and urged in their closing directions by suitable urging means.

In this embodiment, a cooling unit 12 is mounted and fixed on heat insulating box 5. Cooling unit 12 includes a second heat insulating wall 13 constructed independently from first heat insulating walls 2. Heat insulating wall 13 includes a heat insulating material 14 therein.

An upwardly-opening dish-like member 15 is provided above goods container space 1 and in the space surrounded by heat insulating wall 13. Dish-like member 15 is fixed to heat insulating wall 13 and positioned on upper heat insulating wall 2*a* of heat insulating box 5. Side walls 16 of dish-like member 15 are constructed as heat insulating walls including a heat insulating material 17. Rod-like members 18*a* and 18*b* are attached to the outer surfaces of side walls 16, and the respective members push and open dampers 11*a* and 11*b*, respectively.

Figure 5:
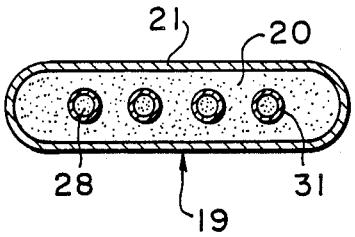
FIG. 5 is an enlarged vertical sectional view of a cold accumulation means and an evaporating tube of the cold preserving container of FIG. 1.

Cold accumulation components 19 as cold accumulation means are disposed in dish-like member 15. Each of cold accumulation components 19 encloses a cold accumulating and cold regenerative material 20. In this embodiment, cold accumulation component 19 comprises a rigid closed case 21 and enclosed cold regenerative material 20 as shown in FIG. 5.

Heat insulating wall 13 covers and is spaced above dish-like member 15. The space between heat insulating wall 13 and dish-like member 15 forms an air path 22 which communicates at end portions thereof with goods container space 1. An air path portion 22*a* between side wall 16 and heat insulating wall 13 defines an air inlet from opening 10*a* to air path 22 and a portion 22*b* defines an air outlet from the air path to opening 10*b*. In this embodiment, the upper wall portion of heat insulating wall 13 is depressed at its central portion, a recessed portion 23 is formed on the outer upper surface of the upper wall portion, and air path 22 is M-shaped in its vertical section as shown in FIG. 1.

A blower 24 positioned in air path 22 is disposed in dish-like member 15 in this embodiment. Blower 24 can circulate air between air path 22 and goods container space 1. A thermostat 25 appropriately positioned in goods container space 1 measures the temperature of the air in the goods container space. Blower 24 is driven by the signal from thermostat 25 as described later.

Figure 3:
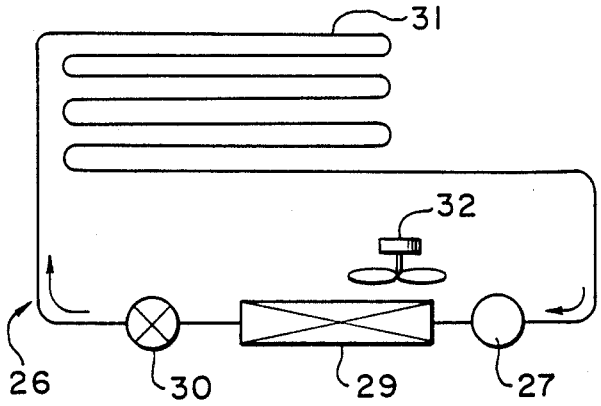
FIG. 3 is a diagram schematically illustrating a cooling system assembled in the cold preserving container of FIG. 1.

In this embodiment as shown in FIGS. 1 and 3, a cooling mechanism 26 for cooling cold accumulation components 19 is assembled in the container. Cooling mechanism 26 includes a compressor 27 compressing a cooling medium 28 (FIG. 5), a condenser 29 condensing the compressed cooling medium, an expansion valve 30 substantially evaporating the condensed cooling medium and an evaporating tube 31 through which the evaporated cooling medium circulates and which cools cold accumulation components 19. This evaporating tube 31 extends through the inside of cold accumulation components 19. A blower 32 for compressor 27 and condenser 29, and a battery 33 for the driving of blowers 24 and 32 and the compressor are assembled in the container. Compressor 27, condenser 29, blower 32 and battery 33 are disposed in recessed portion 23 on heat insulating wall 13.

Figure 4:
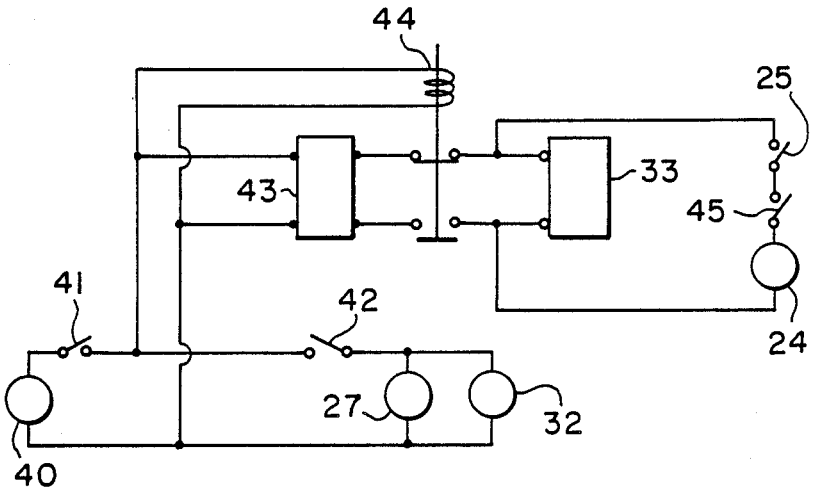
FIG. 4 is a diagram schematically illustrating an electric circuit applied to the cold preserving container of FIG. 1.

FIG. 4 illustrates an electric circuit for the cold preserving container. Originally, electric power is supplied from a commercial power 40 by closing a main switch 41. When main switch 41 is placed in its "on" position, compressor 27 and blower 32 can be driven by commercial power 40 via thermostat 42 which can detect the freezing of cold accumulation component 19. Also, a battery charger 43 and a relay 44 can operate by commercial power 40, and battery 33 is charged by the operation of the relay via the battery charger. Battery 33 is connected to blower 24 via thermostat 25 and a switch 45. Switch 45 is closed when blower 24 is driven and the inside atmosphere or air of the container is cooled, and the switch is opened when cold is accumulated in cold accumulation components 19 or when cold preservation is not required.

When main switch 41 is closed, namely when commercial power 40 is connected, compressor 27 and blower 32 can be driven and battery 33 can be charged, and at the same time, the operation of blower 24 can be controlled by switch 45. When commercial power 40 is not connected, blower 24 can be driven by battery 33 and the operation of the blower can be controlled via thermostat 25.

In this cold preserving container, cold accumulation components 19 are cooled by evaporating tube 31 of cooling mechanism 26, and the components accumulate cold in their enclosed cold regenerative material 20. The cold accumulation components 19 cool the air in dish-like member 15 by the heat exchange between them. If the air in dish-like member 15 does not move, the air is cooled by cold accumulation components 19 to a temperature of the equilibrium of this heat exchange, and thereafter, the heat exchange is substantially stopped.

When the outside air temperature is relatively high, blower 24 is driven by battery 33. By the drive of blower 24, the air in air path 22 and in goods container space 1 circulate. The cold air which is cooled by cold accumulation components 19 in dish-like member 15 flows out from the inside of the dish-like member and falls down into goods container space 1 through air outlet portion 22*b* and opening 10*b*. At the same time the air in goods container space 1 flows into dish-like member 15 through opening 10*a* and air inlet portion 22*a* and the air is cooled by cold accumulation components 19. This air is circulated by blower 24 and the drive of the blower is controlled by the signal from thermostat 25 so as to maintain the temperature in goods container space 1 at a pre-set constant temperature. Therefore, when the outside air temperature is relatively low, the drive of blower 24 is stopped, the cold air cooled by cold accumulation components 19 stays in dish-like member 15, and excessive cooling of goods container space 1 is prevented. Thus, the temperature of the air in goods container space 1 can be maintained at the desired temperature by controlling of the drive of blower 24.

Moreover, since blower 24 can be driven by battery 33, the container can be used in or transported to a place having no power source or no commercial power. Therefore, the container is particularly suited for transporting, as by a vehicle, fresh provisions or products between a warm area and a cold area.

Furthermore, since cold accumulation components 19 are disposed in dish-like member 15 and cooling unit 12 is fixed on heat insulating box 5, the structure is very stable. Even if the container is vibrated during transportation, cold accumulation components 19 remain stable. Therefore, the container can be used for a long distance transportation.

Figure 6:
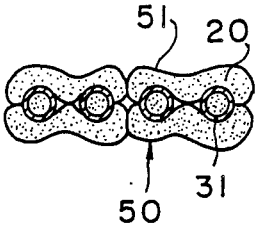
FIG. 6 is a vertical sectional view of a cold accumulation means and an evaporating tube according to another embodiment of the present invention.
Figure 7:
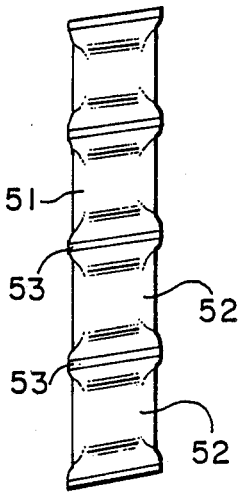
FIG. 7 is a plan view of the cold accumulation means of FIG. 6.
Figure 8:
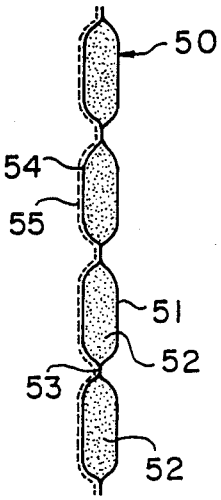
FIG. 8 is a sectional view of the cold accumulation means of FIG. 7.

FIGS. 6–8 show another embodiment of the present invention with respect to a cold accumulation component. In this embodiment, evaporating tube 31 is covered with a cold accumulation component 50 which comprises a package 51, and cold regenerative material 20 is enclosed in the package. Package 51 is constructed of a flexible material, such as a plastic sheet. Package 51 has a plurality of separate small closed chambers 52 formed by heat sealing at portions 53 of the flexible material. Each of small closed chambers 52 encloses cold regenerative material 20. In this embodiment, the flexible material constituting the surface 54 on the side of evaporating tube 31 includes a high thermal-conducting material, such as aluminium. An adhesive 55 is applied on the surface 54 of package 51 on the side of evaporating tube 31, and thus package 51 functions as an adhesive tape.

In this structure, the setting of cold accumulation components 50 is easy and the components can be easily detached or exchanged as needed. The cold accumulation components 50 can be cooled by an appropriate external cooling mechanism as may be required.

Figure 9:
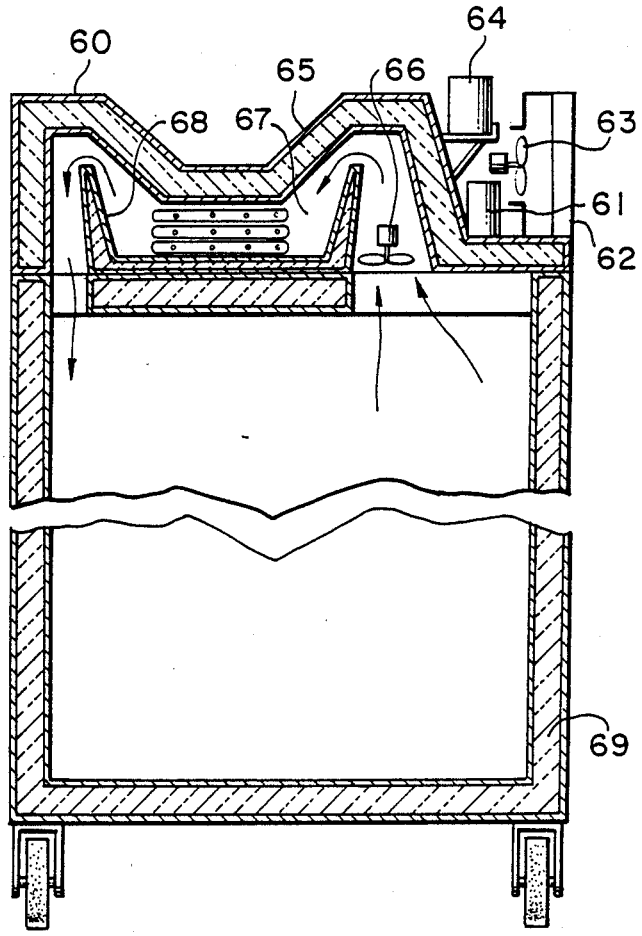
FIG. 9 is a vertical sectional view of a cold preserving container according to a further embodiment of the present invention.

FIG. 9 illustrates a further embodiment of the present invention wherein the structure of the cooling unit and the disposition of equipments are different from that of the container shown in FIG. 1. The structure of second heat insulating wall 60 is different. A compressor 61, a condenser 62, a blower 63 and a battery 64 are disposed outside of a recessed portion 65 on heat insulating wall 60. A blower 66 is disposed in an air path 67 at a position outside of a dish-like member 68. Thus, the equipments can be appropriately positioned. Moreover, a second heat insulating wall can be integrally constructed with first heat insulating walls 69.

Although several preferred embodiments of the present invention have been described herein in detail, it will be appreciated by those skilled in the art that various modifications and alterations can be made to these embodiments without materially departing from the novel teachings and advantages of this invention. Accordingly, it is to be understood that all such modifications and alterations are included within the scope of the invention as defined by the following claims.

What is claimed is:

1. A cold preserving container comprising:

first heat insulating walls surrounding a goods container space;

an upwardly-opening, dish-like member positioned above said goods container space;

a cold accumulator positioned in said dish-like member;

cold regenerative material enclosed in said cold accumulator;

a second heat insulating wall covering and spaced above said dish-like member;

an air path positioned between said second insulating wall and said dish-like member and having air path end portions, said air path communicating at said air path end portions with said goods container space; and a blower means for circulating air between said air path and said goods container space.

2. The container according to claim 1 further comprising a compressor compressing a cooling medium, a condenser condensing the compressed cooling medium, an expansion valve evaporating the condensed cooling medium, and an evaporating tube through which the evaporated cooling medium circulates and which cools said cold accumulator.

3. The container according to claim 2 wherein said second heat insulating wall has an outer upper surface and a recessed portion formed by said outer upper surface, and said compressor and said condenser are disposed in said recessed portion.

4. The container according to claim 2 wherein said evaporating tube extends through and in said cold accumulator.

5. The container according to claim 1 wherein said dish-like member has a heat insulating side wall.

6. The container according to claim 1 wherein said accumulator comprises a package, and said cold regenerative material is enclosed in said package.

7. The container according to claim 6 wherein said package is constructed of a flexible material.

8. The container according to claim 7 wherein said package has a plurality of separate small closed chambers which are formed by heat sealing of said flexible material and each of which encloses said cold regenerative material.

9. The container according to claim 1 wherein said second heat insulating wall is constructed independent of said first heat insulating walls.

10. The container according to claim 1 wherein said second heat insulating wall is constructed integrally with said first heat insulating walls.

11. The container according to claim 1 wherein said air path is M-shaped in its vertical section.

12. The container according to claim 1 further comprising dampers movable to open and close and positioned where end portions of said air path and said goods container space communicate.

13. The container according to claim 1 wherein said dampers are biased closed, and further comprising opening means attached to said dish-like member for opening said dampers.

14. The container according to claim 1 wherein said blower is disposed in said dish-like member.

15. The container according to claim 1 wherein said blower is disposed outside of said dish-like member and in said air path.

16. The container according to claim 1 further comprising a thermostat which measures the air temperature in said goods container space.

17. The container according to claim 1 further comprising a battery which supplies power to at least said blower.

18. The container according to claim 1 wherein said blower means is disposed in said air path.

19. A refrigerator comprising:

an insulated case housing a goods storage area;

a generally upwardly-opening structure disposed above said goods storage area;

a cold accumulator means positioned in said upwardly-opening structure;

cooling means for cooling said cold accumulator means;

path means for defining an air path generally above said upwardly-opening structure, said air path communicating with said goods storage area; and circulating means for circulating air between said air path and said goods storage area and thereby cooling said goods storage area.

20. The refrigerator of claim 19 wherein said circulating means includes a blower and a controlling means for controlling the operation of said blower and thereby the temperature in said goods storage area.

21. The refrigerator of claim 19 wherein said path means includes an insulator wall covering and spaced above said upwardly-opening structure.

22. The refrigerator of claim 19 further comprising damper means for selectively blocking the communication between said air path and said goods storage area.

23. The refrigerator of claim 22 wherein said damper means includes a damper which is biased closed and an opening means attached to said upwardly-opening structure for opening said damper.

24. The refrigerator of claim 19 wherein said circulating means includes a blower disposed in said upwardly-opening structure.

25. The refrigerator of claim 19 wherein said air path has path ends on opposite sides of said upwardly-opening structure.

26. The refrigerator of claim 19 wherein said circulating means includes a blower disposed in said air path.

27. The refrigerator of claim 19 wherein said cold accumulator means is fixed in said upwardly-opening structure.

28. The refrigerator of claim 19 wherein said cold accumulator means includes a flexible package and cold regenerative material enclosed in said flexible package.

29. The refrigerator of claim 28 wherein said flexible package includes a plurality of separate, sealed cold regenerative material pockets.

30. The refrigerator of claim 19 wherein said cooling means includes an evaporator tubing extending through said cold accumulator means.

31. The refrigerator of claim 19 wherein said upwardly-opening structure comprises a dish having an insulated side wall.

* * * * *